US005586817A

United States Patent [19]

Hubbard et al.

[11] Patent Number: 5,586,817

[45] Date of Patent: Dec. 24, 1996

[54] DRAWER INTERLOCK APPARATUS

[75] Inventors: David Hubbard, Stamford; Walter Wolog, Orange, both of Conn.

[73] Assignee: Pitney Bowes Inc., Stamford, Conn.

[21] Appl. No.: 523,728

[22] Filed: Sep. 5, 1995

[51] Int. Cl.[6] ..... A47B 88/00

[52] U.S. Cl. ..... 312/334.44; 312/330.1; 312/222; 312/333

[58] Field of Search ..... 312/216, 217, 312/218, 219, 220, 221, 222, 333, 334.44, 334.45, 330.1

[56] References Cited

U.S. PATENT DOCUMENTS

| | | | |
|---|---|---|---|
| 2,559,579 | 7/1951 | Abrahamson | 312/219 |
| 3,026,149 | 3/1962 | Ruhnke | 312/333 X |
| 3,941,441 | 3/1976 | Scheerhorn | 312/215 |
| 3,973,814 | 8/1976 | Entrikin | 312/333 |
| 4,451,111 | 5/1984 | Munroe | 312/222 X |
| 4,637,667 | 1/1987 | Reid et al. | 312/221 X |
| 4,962,974 | 10/1990 | Fitz | 312/333 |
| 5,056,876 | 10/1991 | Scheerhorn | 312/221 |
| 5,303,994 | 4/1994 | Elsholz | 312/221 |
| 5,352,030 | 10/1994 | Derle et al. | 312/221 |
| 5,484,198 | 1/1996 | Pilliod | 312/330.1 X |

*Primary Examiner*—Peter M. Cuomo
*Assistant Examiner*—James O. Hansen
*Attorney, Agent, or Firm*—Ronald Reichman; Melvin J. Scolnick; Brigitte L. Jeffery

[57] ABSTRACT

An interlock mechanism is provided for a document handler having a pair of drawers for storing documents to prevent the simultaneous extension of more than one of the drawers. The drawer interlock apparatus comprises a frame and a longitudinal rail mounted to a side wall of each drawer. Each rail has a pair of substantially L-shaped stops and a locating notch positioned between the stops. A locking mechanism is pivotally mounted to the frame. The locking mechanism is slideably engaged with the rail of each drawer for preventing the simultaneous extension of the multiple drawers. Each drawer also has link mechanisms for adjusting drawer alignment to meet document registration requirements.

5 Claims, 2 Drawing Sheets

DRAWER INTERLOCK APPARATUS

BACKGROUND OF THE INVENTION

The present invention relates generally to a structural element for locking a horizontally movable drawer.

Drawers for storing paper are generally well known in the document handling art, and typically include multiple drawers. Because each drawer may store paper of various size, for operator convenience, the prior art drawers typically lack some type of drawer interlock mechanism that will permit only one of the drawers to be opened at any given time.

In the furniture cabinet art, many different interlock systems have been developed in an attempt to economically, yet reliably, interlock the drawers on vertical cabinets. However, such prior art mechanisms are not readily adapted to the rigorous document registration requirements in the document handling field. Drawers may create error conditions, such as paper jams, if the center line of multiple drawers are not maintained in proper alignment.

Thus, it is an object of the subject invention to provide an interlock mechanism for multiple drawers in a document handling system.

Further, it is an object of the subject invention to provide means for adjusting drawer alignment to meet document registration requirements.

SUMMARY OF THE INVENTION

The above objects are achieved and the disadvantages of the prior art are overcome by means of the subject invention for a drawer interlock apparatus for use in a document handler having multiple drawers, which comprises a frame and a longitudinal rail mounted to a side wall of each drawer. The rail has a pair of substantially L-shaped stop means and a locating notch positioned between the stop means. Locking means are pivotally mounted to the frame. Further, the locking means are slideably engaged with the rail of each drawer for preventing the simultaneous extension of the multiple drawers.

DESCRIPTION OF THE DRAWINGS

The objects and advantages of the present invention will become apparent from the following description of the accompanying drawings. It is to be understood that the drawings are to be used for the purpose of illustration only, and not as a definition of the invention.

In the drawings.

DETAILED DESCRIPTION OF THE INVENTION

Figure 1:
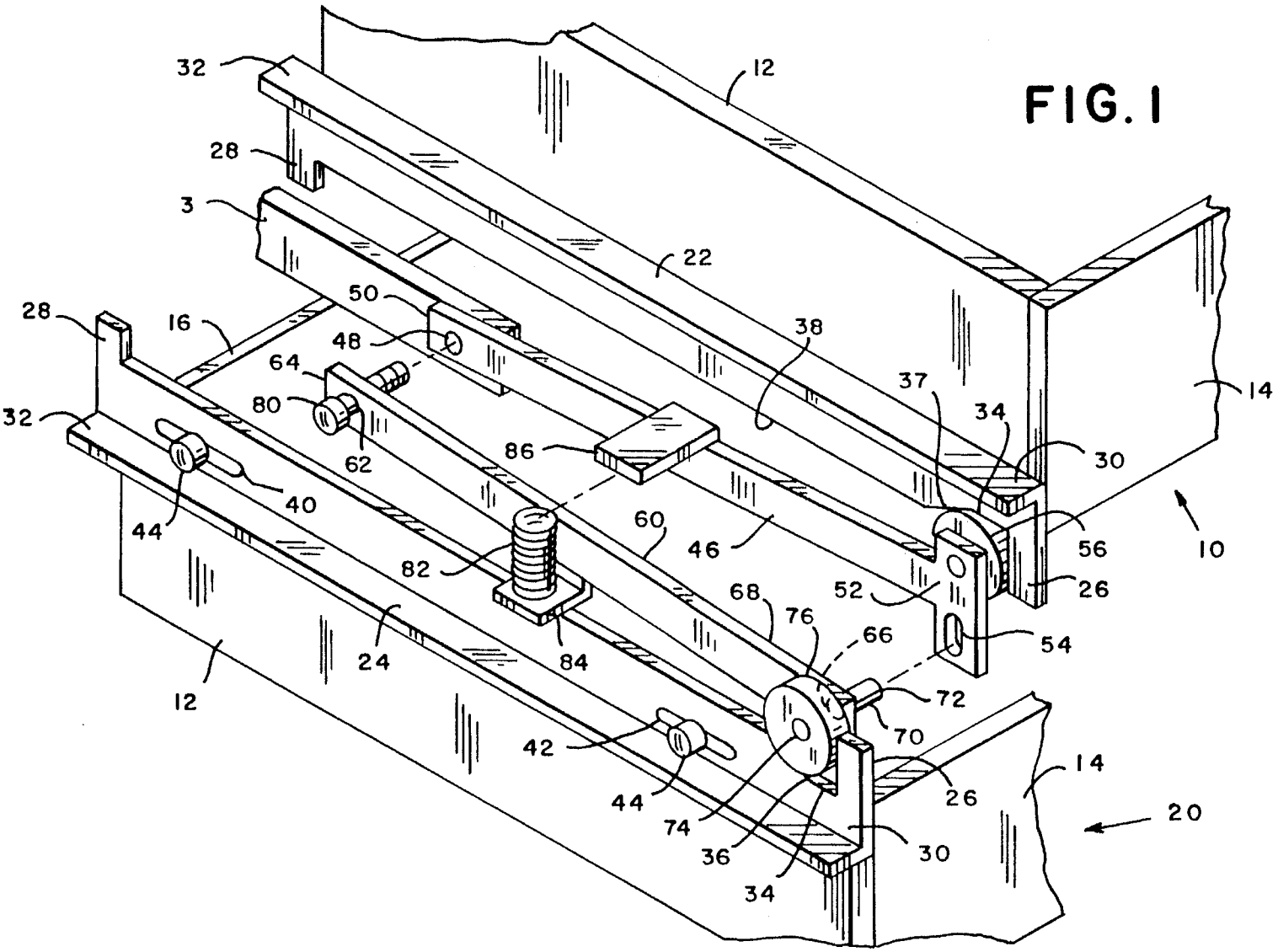
FIG. 1 is a perspective view of a pair of drawers incorporating the invention, and, FIG. 2 is a side view thereof.

FIG. 1 illustrates a frame 3 for receiving a pair of drawers 10, 20 having side walls 12, a front panel 14, a rear wall 16, and a longitudinal rail 22, 24 mounted to the side wall 12. A supporting element (not shown) is provided for supporting each drawer 10, 20.

The rail 22, 24 has a pair of substantially L-shaped travel limiting stops 26, 28 at the front end 30 and rear end 32 of the rail 22, 24. An asymmetrical notch 34 having a sloped surface 36, 37 is located between stops 26 and 28. The angle of the sloped surface 36, 37, along with the mass of each drawer 10, 20, determines the amount of force required to open each drawer 10, 20. Because the mass of each drawer 10, 20 may differ, in a preferred embodiment of the invention, the angle of sloped surface 36 is different from the angle of sloped surface 37. By adjusting the angle of sloped surface 36, 37, the same amount of force may be used to open drawers having a different mass.

A horizontal surface 38 of the rail 22, 24 extends between stop 28 and notch 34. The rail 22, 24 further has a plurality of elongated slots 40, 42 so that the rail 22, 24 can be securely joined to the side wall 12 by tightening the fastening bolts 44. The drawers 10, 20 may be realigned by loosening the fastening bolts 44, adjusting the drawer 10, 20 in a horizontal direction with respect to the rail 22, 24, and tightening the fastening bolts 44. This adjustment can be performed so that the center line of multiple drawers are maintained in proper alignment.

Still referring to FIG. 1, a first link mechanism 46 has an aperture 48 at a first end 50, and a substantially T-shaped opposite end 52. The opposite end 52 has an elongated slot 54 and a roller 56 rotatively mounted to end 52. A second link mechanism 60 has an aperture 62 at a first end 64, and an aperture 66 at the opposite end 68. The opposite end 68 includes a shaft 70 extending through the aperture 66 such that an end 72 of the shaft 70 extends generally perpendicular through the elongated slot 54 of the first link mechanism 46 while the other end 74 of the shaft 70 has a roller 76 rotatively mounted thereto. The link mechanisms 46 and 60 are pivotally mounted to the frame 3 by screw 80 which passes through apertures 48 and 62. A compression spring 82 is attached to tabs 84 and 86 which are fixedly connected to link mechanisms 46 and 60 respectively. Because of the common pivot point, the spring 82 urges the link mechanisms 48 and 62 apart in a scissors-like motion.

Figure 2:
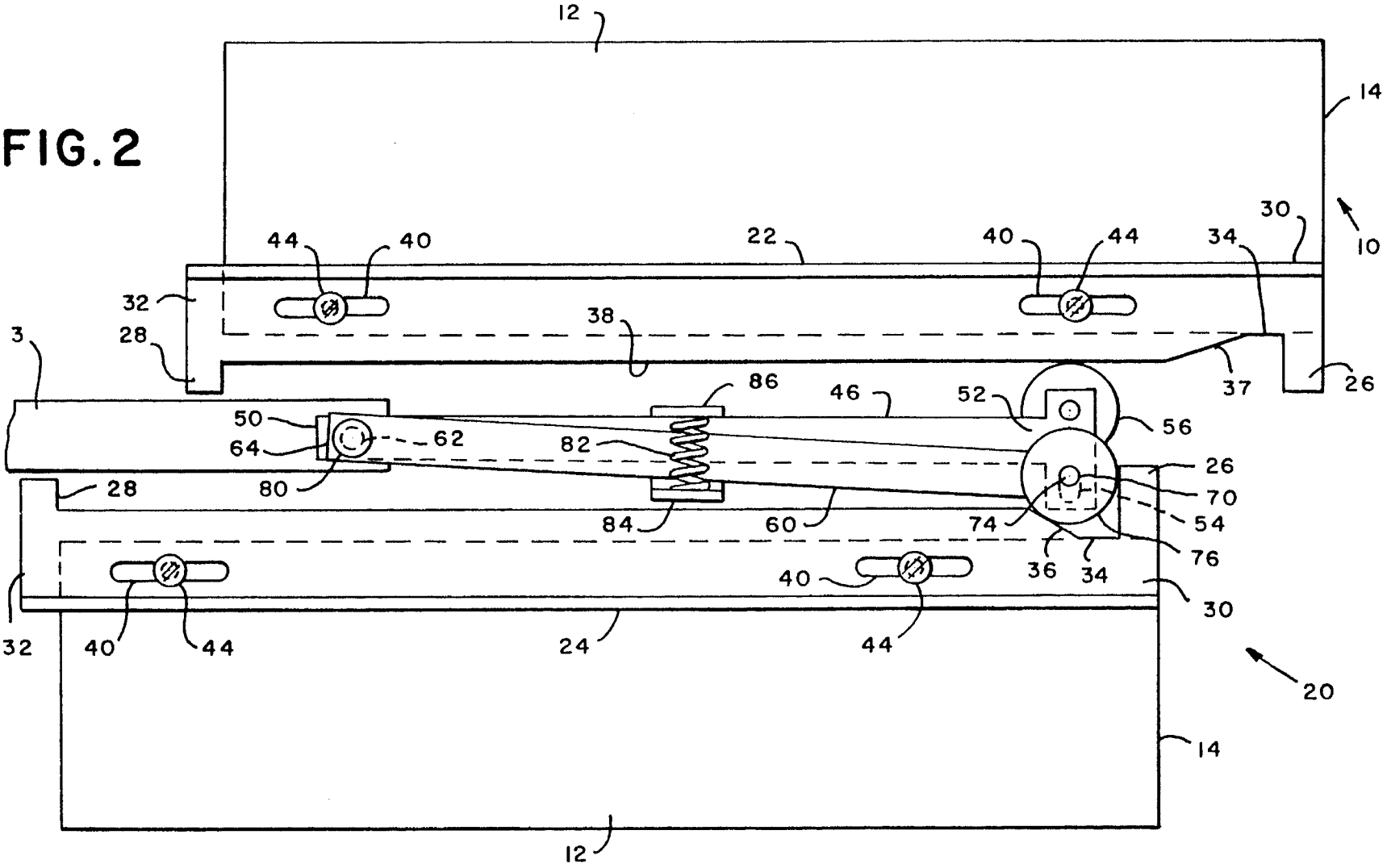

Referring to FIG. 2, in operation, drawer 10 is extended in a substantially horizontal direction. The roller 56 begins to travel along the sloped surface 37 of the rail 22. As the roller 56 reaches the lowest portion of the sloped surface 37 of the notch 34, the elongated slot 54 is lowered onto the shaft 70. Because the distance across the diameter of rollers 56 and 76 is greater than the distance across link 46 and 60, the second roller 76 is prevented from traveling along the surface 38 of the second rail 24. An operator may then extend the drawer 10 until roller 56 reaches stop 28.

Similarly, if the lower drawer 20 were opened, the roller 76 would travel along the sloped surface 36 of the rail 24. As the roller 76 engages the sloped surface 36 of notch 34, the shaft 70 would travel in a substantially vertical direction within the elongated slot 54 thereby preventing the top drawer 10 from being simultaneously extended. An operator may then extend the drawer 20 until the roller 76 reaches stop 28.

The foregoing description of the preferred embodiment of the present invention have been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. A pair of drawers having a drawer interlock apparatus, each of the drawers including opposite side walls, a rear wall, and a front panel, the interlock apparatus comprising:

a frame;

a pair of longitudinal rails, each rail mounted to a side wall of each drawer, each rail including a front end and a rear end, a pair of substantially L-shaped stop means, one of the pair of stop means being situated at the front end of the rail, the other of the pair of stop means being situated at the rear end of the rail, and a locating notch having an angled surface positioned between the stop means; and, locking means pivotally mounted to the frame, the locking means further being slideably engaged with the rail of each drawer for preventing the simultaneous extension of the pair of drawers wherein the locking means comprises:

a pair of link mechanisms having a first end pivotally mounted to the frame, one of the pair of link mechanisms having a substantially T-shaped opposite end including an elongated slot, the other of the pair of link mechanisms having a pin fixedly mounted at an opposite end for engaging the elongated slot;

a spring interposed between the pair of link mechanisms; and roller means rotatably mounted to the opposite end of each link mechanism and fitting into the locating notch, the roller means being engaged with the rail of each drawer so that as the roller means move toward the rear end of one of the pair of drawers, the spring compresses and the pin engages the elongated slot thereby prohibiting movement of the roller means engaged with the other of the pair of drawers.

2. A drawer interlock apparatus in accordance with claim 1 wherein the locating notch of each rail has an angled surface.

3. A drawer interlock apparatus in accordance with claim 2 wherein the angled surface of one rail has a slope greater than the angled surface of the other rail.

4. A drawer interlock apparatus in accordance with claim 1 wherein the locking means comprises:

a pair of link mechanisms having a first end pivotally mounted to the frame, one of the pair of link mechanisms having a substantially T-shaped opposite end including an elongated slot, the other of the pair of link mechanisms having a pin fixedly mounted at an opposite end for engaging the elongated slot;

a spring interposed between the pair of link mechanisms; and roller means rotatably mounted to the opposite end of each link mechanism and fitting into the locating notch, the roller means being engaged with the rail of each drawer so that as the roller means move toward the rear end of one of the pair of drawers, the spring compresses and the pin engages the elongated slot thereby prohibiting movement of the roller means engaged with the other of the pair of drawers.

5. A drawer interlock apparatus in accordance with claim 1, further comprising adjustment means for adjusting the horizontal position of each drawer.

* * * * *